US005219194A

United States Patent [19]

Trent et al.

[11] Patent Number: 5,219,194

[45] Date of Patent: Jun. 15, 1993

[54] SECURITY SEAL

[75] Inventors: Steven J. Trent, Grand Rapids; Michael J. Ponsetto, Hastings, both of Mich.

[73] Assignee: Viking Corporation, Hastings, Mich.

[21] Appl. No.: 843,729

[22] Filed: Feb. 28, 1992

[51] Int. Cl.[5] ..... B65D 33/34

[52] U.S. Cl. ..... 292/307 R; 24/703.1

[58] Field of Search ..... 292/307 R, 307 A, 322, 292/325; 40/2.2, 626, 714; 283/9 R, 93, 99

[56] References Cited

U.S. PATENT DOCUMENTS

| | | | |
|---|---|---|---|
| 1,298,992 | 4/1919 | Merklee et al. . | |
| 1,601.973 | 10/1926 | Leslie et al. . | |
| 1,791,352 | 2/1931 | Colonnese . | |
| 1,979,508 | 11/1934 | Van Den Bel . | |
| 1,985,834 | 12/1934 | Lawrence . | |
| 1,996,288 | 4/1935 | Galt . | |
| 2,013,299 | 9/1935 | Byrne | 292/307 A |
| 2,360,325 | 10/1944 | Higbee | 292/307 R |
| 2,919,508 | 1/1960 | Stanley . | |
| 2,984,030 | 5/1961 | Hannon . | |
| 3,152,901 | 10/1964 | Johnson . | |
| 3,417,497 | 12/1968 | Hannon . | |
| 3,430,300 | 3/1969 | Doan . | |
| 3,463,532 | 8/1969 | Chidley et al. | 292/307 R |
| 3,631,617 | 1/1969 | Pekko . | |
| 3,802,724 | 4/1974 | Gosnell . | |
| 3,837,101 | 9/1974 | Young . | |
| 3,864,855 | 2/1975 | Pekko et al. . | |
| 3,896,965 | 7/1975 | Cornell . | |
| 3,923,198 | 12/1975 | Brochman . | |
| 3,974,311 | 8/1976 | Cherrin . | |
| 3,983,645 | 10/1976 | Rycroft | 292/307 A |
| 4,017,994 | 4/1977 | Fraser . | |
| 4,082,873 | 4/1978 | Williams . | |
| 4,121,003 | 10/1978 | Williams . | |
| 4,174,857 | 11/1979 | Koza . | |
| 4,184,701 | 1/1980 | Franklin et al. . | |
| 4,389,063 | 6/1983 | Ryan | 292/307 R |
| 4,428,997 | 1/1984 | Shulman . | |
| 4,557,505 | 12/1985 | Schaefer et al. . | |
| 4,584,238 | 4/1986 | Gen et al. . | |
| 4,708,369 | 11/1987 | Greig . | |
| 4,763,931 | 8/1988 | Matsuguchi et al. . | |
| 4,876,123 | 10/1989 | Rivera et al. . | |
| 4,980,222 | 12/1990 | Rivera et al. . | |
| 4,988,547 | 1/1991 | Voto, Jr. et al. . | |

FOREIGN PATENT DOCUMENTS

| | | |
|---|---|---|
| 2831587 | 1/1980 | Fed. Rep. of Germany . |
| 0615666 | 1/1949 | United Kingdom . |

OTHER PUBLICATIONS

Exhibits A1 and A2 are photographs of a known plastic security seal that can be formed into a loop.

*Primary Examiner*—Richard E. Moore

*Attorney, Agent, or Firm*—Price, Heneveld, Cooper, DeWitt & Litton

[57] ABSTRACT

A security seal and method for detecting tampering. The security seal includes a first member, an adhesive layer applied to the first member, and an indicia printed directly on the adhesive layer in a desired detectable pattern. In one embodiment, the first member is adhered to the second member with the indicia detectable at least through the first member. With this arrangement, the pattern becomes detectably disrupted if the first and second members are moved relative to each other. In the preferred embodiment, both of the first and second members are part of a single transparent strip that can be looped through a shipping container locking mechanism and attached to prevent unauthorized access to the shipping container. In one form, tamper indicating tape is used to form the tamper indicating message "VOID" thereon if tampered with, thus giving a second visual indication of tampering. Heat sensitive material is used to prevent overcoming the tamper indicating tape by heating. A method embodying the present invention includes providing a strip with adhesive thereon, printing a disruptable pattern on the adhesive, adhering the strip to a surface by use of the adhesive, and inspecting same for tampering.

47 Claims, 2 Drawing Sheets

SECURITY SEAL

BACKGROUND OF THE INVENTION

The present invention relates to security seals, and in particular to an article and method for detecting tampering on a security seal, and a process for making the security seal.

Security seals are commonly used to ensure that goods or articles contained in a shipping container have not been disturbed or tampered with during transport. Historically, these security seals have been made of metal bands. However, metal seals rust or corrode, and include sharp corners and edges that can be harmful to a person using them.

Recently, plastic seals have become popular since they are more user friendly. Typically, plastic seals are designed with weak points so that they break in a visible location upon tampering. However, these plastic seals have not proven to be as secure or reliable as metal seals since the plastic seals tend to break accidentally, thus defeating their purpose. Further, many experts claim that plastic seals can be defeated by using heat or glue. For example, one type of plastic security seal includes a seal connector housing that can be overcome by using a thin pin to manipulate the pin and socket lock mechanism in the housing, then later reattaching the seal using glue and the like. Other methods to defeat plastic seals include heating the plastic seal in water to soften the seal and cause breakage in a hidden area. Thus when the seal is reassembled, the break is difficult to see or detect until the final destination is reached and the seal is removed, at which time the discovery of tampering is of little value. Further, plastic seals tend to be bulky to ship and store, and less than cost competitive in some applications.

Thus a security seal is desired to improve upon the aforementioned problems.

SUMMARY OF THE INVENTION

The present invention is a security seal for detecting relative motion between two members. The invention includes a security seal having an adhesive means joining the two members together at a location whereat the relative motion is to be detected, the adhesive means having printed indicia applied directly thereon in a pattern prior to joining the two members together at the location, and the seal also including means for inspecting the printed indicia as applied. The indicia pattern is disrupted upon relative motion between the members after initial joinder by the adhesive, thus reflecting that the seal has been tampered with. In the preferred embodiment, the members are transparent to permit ready visual inspection of the indicia pattern from both sides.

In one aspect, the invention includes a security seal connectable between a shipping container with an access port and a movable door for covering the access port. The security seal includes a flexible strip including two portions, and adhesive means for joining the two portions together so that the flexible strip forms a loop. The adhesive means includes tamper indicating means for indicating relative motion between the two portions of the flexible strip after the two portions are joined. Also, the seal includes means for inspecting the tamper indicating means, the tamper indicating means being detectably disturbed upon relative motion between the two portions after initial joinder. In the preferred embodiment, the tamper indicating means includes both a tamper indicating tape which is separable upon relative movement between the two portions, and also disruptable indicia which is printed on the adhesive of the tamper indicating tape and which is disturbed upon relative movement of the two portions. Also in the preferred embodiment, a heat sensitive material is applied to one of the members, the heat sensitive material changing color if heated, thus providing evidence of an attempt to tamper with the security seal by heating the seal to a temperature at which the two members can be separated and reattached without disturbing the tamper indicating means.

In another aspect, the invention includes a security seal including a flexible strip, adhesive located on the strip for adhering the flexible strip to a flat surface, indicia printed on the exposed surface of the adhesive in a predetermined pattern, and the adhesive means including disruption means for disrupting the predetermined pattern if the strip is undesirably moved relative to the flat surface after attachment. Further, the security seal includes inspection means for sensing if the pattern has been disrupted.

In a yet narrower aspect of the invention, a narrow clear plastic strip is provided with one end being tapered to form a tongue portion and means defining an opening spaced from the other end to permit the tongue portion to be frictionally inserted in the opening to form an initial closed loop after said strip is inserted through a clasp or the like of a container to be sealed. Adhesive means are applied to the other end outwardly of the opening, the adhesive including "void" indicating indicia consistent with that produced and sold by 3M Company under the product no. 7380 and 7381. The adhesive includes a releasable covering which, when removed, permits the other end to be adhered to the opposite end of the strip inwardly of the tongue portion permanently securing the plastic strip in a closed loop such that if adhesive region is tampered with by relative movement of said adhered ends, a void pattern will reflect the evidence of tampering. Concurrently, additional indicia can be applied by noncontact printing to the adhesive prior to joinder of the ends, which indicia is disrupted by any relative movement between said adhered portions thereby also indicating the presence of tampering. The application of indicia directly on the adhesive eliminates any potential defeat of the security seal by application of elevated or reduced temperatures which might defeat the adhesive itself. Relative movement of the two adhered members, whether disrupting the adhesive or not, will interrupt the indicia pattern regardless of the amount of care taken in separating or reapplying same after the removal of excessive or reduced temperature gradients.

The present invention also is embodied in a method including providing a strip with adhesive thereon, printing a disruptable pattern on the adhesive, adhering the strip to a flat surface by use of the adhesive, and inspecting the disruptable pattern to determine if the pattern has been disrupted.

In another aspect, a method is provided for detecting tampering with a shipping container which is provided with an access port, a movable door associated with the access port, and a lockable mechanism associated with a door. The method includes providing a security seal having adherable portions with a disruptable pattern of indicia associated with the adherable portions, extending the security seal around the lockable mechanism, adhering the portions of the seal together to form a loop, and inspecting the disruptable pattern to determine if relative movement has occurred between the adherable portions during shipping hence indicating the lockable mechanism has been tampered with.

A process of the present invention includes providing a flexible strip with adhesive located thereon, the adhesive having an exposed surface, and printing a disruptable pattern on the exposed surface. In the preferred embodiment, the process includes printing on the adhesive of a tamper indicating tape, adhering a first portion of the tamper indicating tape to a flexible sheet by use of the adhesive with a second portion overhanging from said sheet, and cutting a plurality of security seals from the flexible sheet and strip thereby formed.

The present invention includes several advantages over known security seals. The security seal embodying the present invention is difficult to defeat or overcome, and includes two positive ways to indicate that tampering has taken place. Not only is the printed indicia itself visibly disrupted upon tampering, but a positive message appears internally in the tamper indicating tape indicating that tampering has occurred. Still further, the seal does not contain mechanical weak points intended to fracture, thus reducing or eliminating the problem of accidental breakage of the seal. Also, the seal maintains the user friendliness typical of plastic seals, such as dulled edges which do not tend to cut a person installing or removing the seal. Further, the seals of the present invention do not rust or corrode. Still further, the security seal is low cost, and readily manufacturable. Also, the security seal is planar such that it is compact to ship and store. Additionally, the seal includes a pointed end that can be threaded through a hole for temporarily holding the seal while the adhesive portion is attached, thus making the seal easy to use.

Other aspects, objects, and advantages of the present invention will become obvious to one of ordinary skill in the art when studied in conjunction with the description, claims and appended drawings.

DETAILED DESCRIPTION OF THE PREFERRED EMBODIMENT

Figure 1:
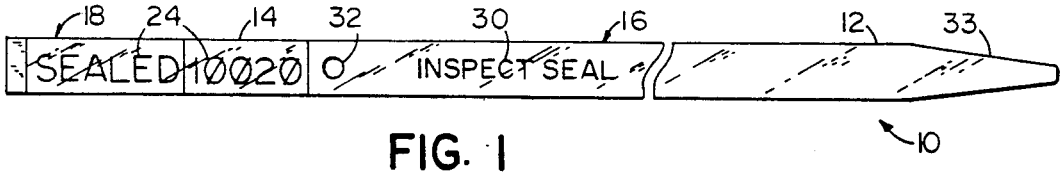
FIG. 1 is a plan view of a security seal embodying the present invention.
Figure 2:
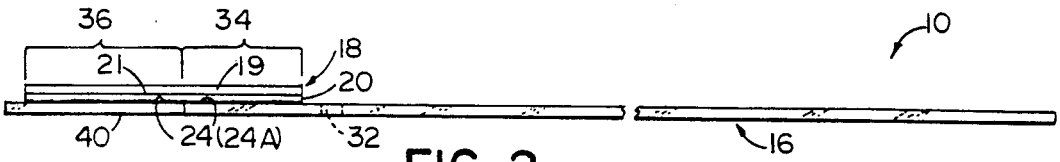
FIG. 2 is a side view of the security seal in FIG. 1.
Figure 6:
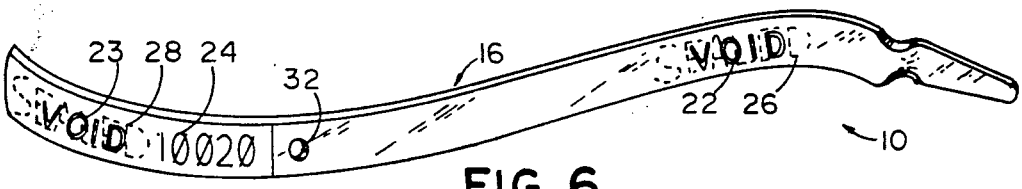
FIG. 6 is a perspective view of a previously installed security, seal that was removed by tampering.

A security seal 10 (FIGS. 1–3) embodying the present invention is provided for detecting relative motion between two members such as members or end portions 12 and 14 of flexible strip or band 16. Security seal 10 includes adhesive means in the form of a tamper indicating tape 18 attached to end portion 14, tape 18 having a backing strip 19 and an adhesive layer 20 for joining members 12 and 14 together. When members 12 and 14 are separated after being joined, tape 18 gives a detectable indication of tampering such as the "VOID" indication 22 and 23 (FIG. 6). To further reduce the opportunity to hide the tampering such as by covering or removing the "VOID" indications 22 and 23 by a white paint and reattaching members 12 and 14, seal 10 further includes a printed indicia 24 which is applied directly to adhesive 20 on tape 18. Upon separating members 12 and 14, indicia 24 is physically separated so that one part 26 of indicia 24 remains with member 12, and another part 28 of indicia 24 remains with member 14. Further, adhesive 20 is tacky, and blurs indicia 24 as members 12 and 14 are moved apart.

Figure 4:
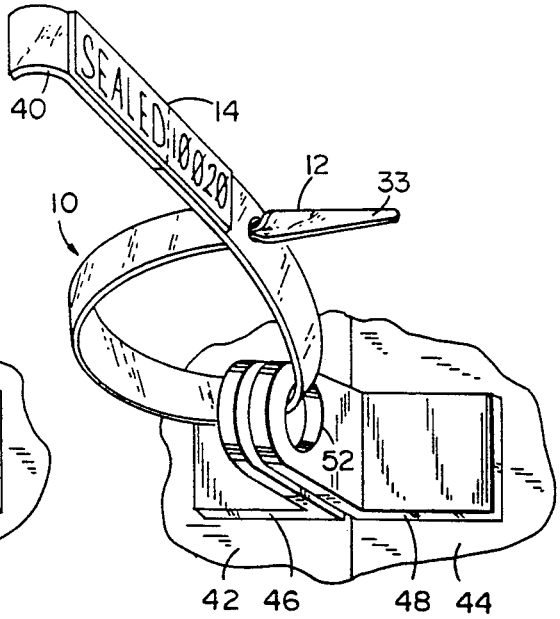
FIG. 4 is a perspective view of a partially installed security seal.

As shown, flexible strip 16 is about ⅜" wide and about 9" long. End portion 14 includes a hole 32, and end portion 12 includes a pointed tip 33 so that end portion 12 can be threaded into hole 32 to form a loop (FIG. 4). As end portion 12 enters hole 32, the sides of end portion 12 collapse so that end portion 12 is temporarily held therein.

In the preferred embodiment, flexible strip 16 is made of a clear polyester treated to accept printing and adhesive, and has a thickness of 0.007 inches. This thickness is adequate for easy handling, but also has some rigidity so that strip 16 can be manipulated in the field environment satisfactorily. Also, the material is quite strong, and offers a good surface for adhesion. Further, polyester can accept printing on a permanent basis so that instructions 30 for installation or inspection of seal 10 can be printed directly on flexible strip 16. However, it is contemplated that other materials would also work, such as polyvinylchloride (PVC) and polyethylene (PE), but with the properties of adhesion, printability, and strength somewhat negatively impacted.

Tamper indicating tape 18 (FIG. 2) includes two halves 34 and 36. Tape half 34 is adhered to end portion 14 with tape half 36 overhanging off the edge of end portion 14. Release paper 40 is attached to the exposed portion of adhesive 20 to prevent accidental and premature attachment of tape half 36 to an undesired surface.

The void indicating material or tape 18 shown is a commercially available product made by Minnesota Mining and Manufacturing Company (3M Company) under their product no. 7380 (matte) or 7381 (glossy), though it is contemplated that different tamper indicating tapes could be used which would give a permanent and conclusive indication of loss of seal integrity. The particular tape 18 noted above includes a translucent white film of material 21 located between backing strip 19 and adhesive 20. White film material 21 is adhered to backing strip 19 so that when tape 18 is first applied and then later removed, the later removal physically separates white film material 21 to form "VOID" indications 22, 23. Backing strip 19 is transparent and, with transparent strip 16, allows complete viewing of the tamper indicating pattern 22 and 23 (FIG. 6).

Figure 7:
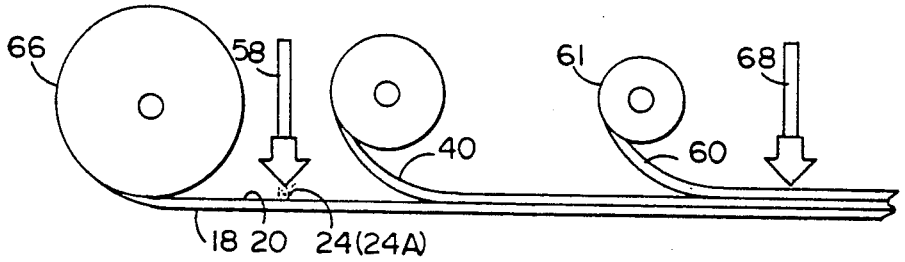
FIG. 7 is a schematic view showing a process embodying the present invention for making security seals.

Indicia 24 is printed onto the exposed tacky surface of adhesive 20 (FIGS. 3, 7 and 8) before applying release paper 40. It is contemplated that a noncontact printing process will be used to print a non-drying ink thereon, however, different types of ink could be used. In particular, any ink offering visible evidence of disruption when end portions 12 and 14 are separated and adhesive 20 is disrupted can be used. Thus, this invention includes inks forming films as well as non-drying inks, although inks having a low internal strength are thought to work best since these inks tend to blur as the adhesive layer 20 is disturbed by the forced separation upon tampering. Also, the invention is contemplated to include non-visible inks or other materials which can be printed onto adhesive 20. For example, inks which emit non-visible light such as ultraviolet light, or which contain particles that can be sensed by X-ray, could also be used.

Figure 3:
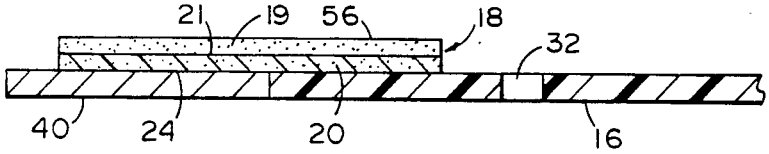
FIG. 3 is an enlarged fragmentary sectional view of the security seal in FIG. 2.

Printing directly on adhesive 20 is important for security seals to prevent someone from defeating seals 10. The original design intentions of the tamper indicating tape 18 was to act as label stock for conventional printing, with information being printed on the non-adhesive containing side 56 of backing strip 19 of tape 18 (FIG. 3). However where the goods are in more secluded environments, once someone has removed the tape or label from the protective band, there is an opportunity to simulate the unactivated state by simply spraying white paint or white adhesive onto indications 22 and 23 to cover-up the indicated "void" pattern 22 and 23 that is exposed by pulling up the tamper indicating tape 18. Thus, there would be no indication the label had been removed from its protected item, and one would have to resort to pulling the label up and noticing there is no "VOID" pattern to discover this tampering. This is not practical for security seals, as it would defeat the integrity of the seal. Restated, destructive testing does not make sense for seals. In the present arrangement, once tape 18 has been activated, there is no way to disguise this fact without severely damaging the markings and serialization that were placed upon the adhesive layer. This damage would provide visible evidence that the seal had been opened.

Also, in more secluded environments, there is a potential for heating seal 10 to overcome the seal, since most tamper indicating tapes cannot withstand high temperatures. In such case, the high temperature heating causes trouble in that many times the "VOID" patterns 22 and 23 will not appear upon separation of the two portions 12 and 14. For example, the 3M tape mentioned earlier may experience this problem at about 160° F. or above.

To further enhance the tamper indicating ability of seal 10, a heat activated, color changing material 24A (FIG. 2) is applied to tape 18 on both halves 34 and 36. It is contemplated that a number of different heat sensitive materials could be used. In the preferred embodiment, a color-former material is mixed with an activator and a catalyst to obtain a mixture that will change color at a predetermined temperature. The color-former material contemplated for use is a material called "CVL-T" made by Hilton Davis Chemical Company of Cincinnati, Ohio. The CVL-T material is mixed with an activator known commonly as bisphenol A (technically named 4, 4 Prime-Isopropylidenediphenol) and a catalyst commonly known as stearimide (technically named Octadecanamide). The proportions contemplated for use are one part CVL-T, 2.5 parts bisphenol A, and 1.5 parts stearimide. A small quantity of this mixture is applied to both parts 34 and 36 of the tamper evident tape 18 on the adhesive layer 20. If possible, two small "VOID" patterns should be printed on the tape parts 34 and 36 with this material, if manufacturing equipment will allow this. Otherwise, some other pattern can be used. Thus, when seal 10 is heated in an attempt to circumvent tampering indicating tape 18, a "VOID" pattern appears much like the void patterns 22 and 23 noted earlier.

Figure 5:
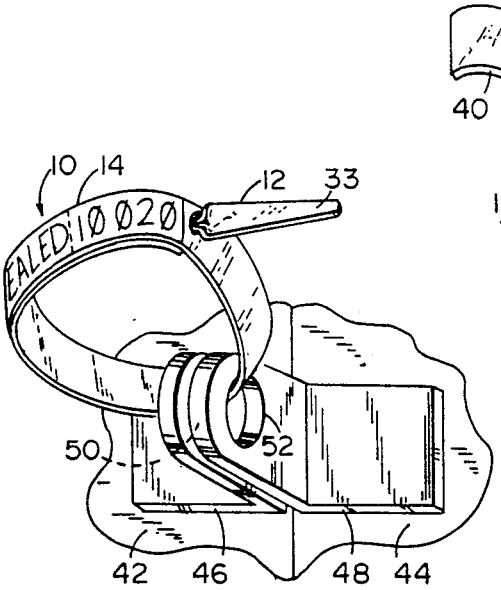
FIG. 5 is a perspective view of a fully installed security seal.

Security seal 10 (FIGS. 4–5) is intended for use on a shipping container 42 having an access port, a movable door 44 for closing the access port, and a locking mechanism illustrated by items 46 and 48 with holes 50 and 52. To use security seal 10, seal 10 is threaded through locking mechanism holes 50 and 52 and end portion 12 is threaded partially into hole 32 to form a loop (FIG. 4). This arrangement temporarily holds seal 10 in the shape of a loop so that end portion 12 can be aligned with end portion 14. Release paper 40 is then removed, and tape half 36 is adhered to end portion 12 (FIG. 5).

As installed on shipping container 42, the indicia 24 and tamper evident tape 18 can be viewed from either side of the seal 10, front or back, or at an angle, and thus allows virtually 100% checking capability. Of course, any cutting or re-affixing of the band would indicate an obvious attempt at tampering, both by appearance of the "VOID" indications 22 and 23, and also by the disruption of printed indicia 24, as noted above.

In the present loop design, there is provided good strength, thus reducing the problem of accidental breakage. The arrangement results in a shear load on the adhesive tape when the loop is pulled, as opposed to weaker type plastic loops that utilize tensile, cleavage or peel loads. For example, many plastic seals break with a static load of about 25 pounds, while the present seals were tested to have a strength in the area of 55 pounds.

Additionally, the construction of seal 10 allows easier use since the loop formed by seal 10 is self-supporting before tape half 36 is applied. This eliminates a problem of a "moving target" when a person installing seal 10 is trying to apply tape half 36 to the seal end portion 16. Further, testing indicates that this material as provided by 3M Company can withstand a wide range of environmental conditions and still provides its indication pattern, and its retention strength.

Seals 10 are thin and planar, weighing about 75% less than conventional plastic seals and taking up about 95% space, thus making the seals less expensive and easier to ship and store. Also, as described below, seals 10 can be arranged in a sheet of 25 or 50 so that they can be easily carried such as in a shipping foreman's back pocket, for attachment to containers on a dock. Further, by keeping the seals interconnected, the serial numbers can be kept in numerical sequence.

Figure 8:
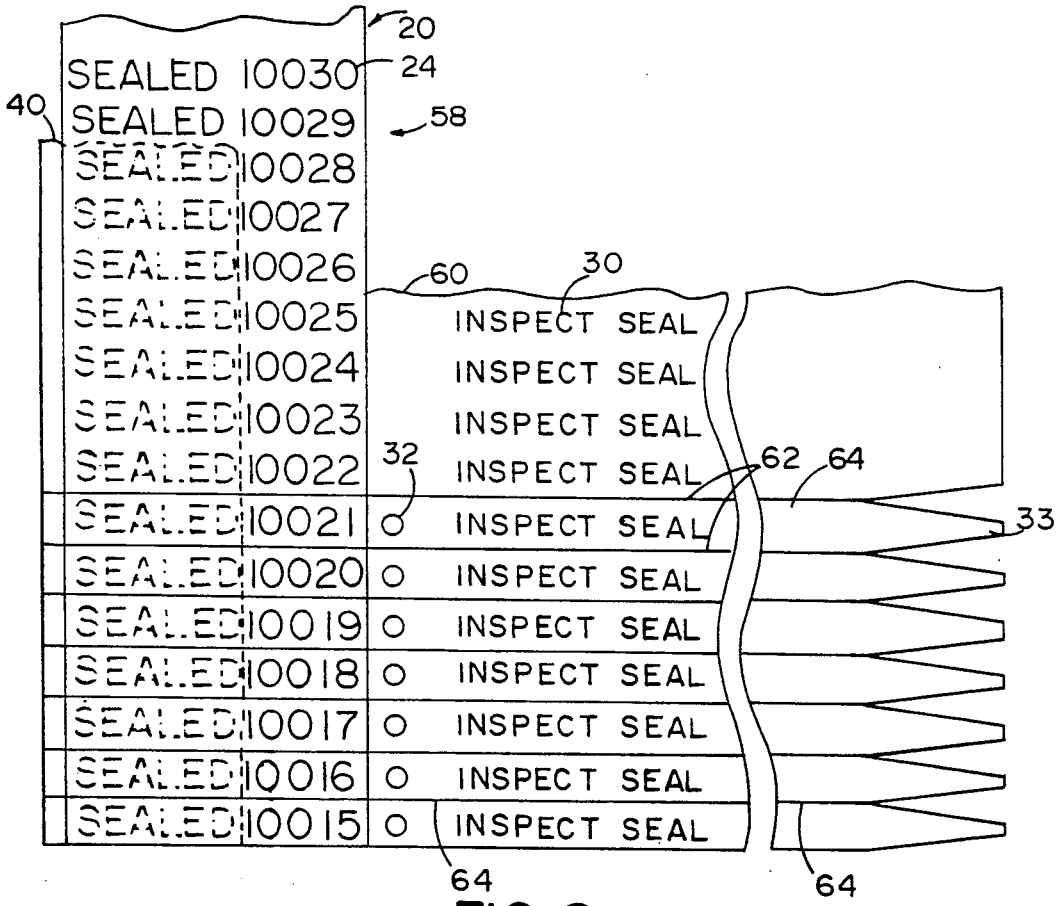
FIG. 8 is a plan view of the security seal illustrating the appearance of same at various steps in the process shown in FIG. 7.

Concerning the process of manufacturing seals 10 (FIGS. 7 and 8), rolls 66 of the tamper indicating tape 18 are unrolled and printed on by noncontact printing press 58 to print serial numbers and other indicia 24 onto the exposed adhesive surface of adhesive 20. Also, high temperature indicating mixture 24A is printed or sprayed onto adhesive 20 in a pattern as desired, such as a "VOID" pattern. After printing, a portion of release material 40 is applied to adhesive tape 20 on portion 36 (FIG. 8). The exposed portion 34 of tape 18 is then attached to sheet 60 in a substantially continuous process. Sheets 60 are then punched by dies to form holes 32 and slit by slitters to form the pointed shape 33 of end portion 16 at station 68. The slitters also score flexible sheet 60 along score lines 62 to form multiple adjacent seals 10 in sheet 60. Seals 10 are removably held together in sheets 60 after slitting by breakable tabs 64 such that they are easily removed when it is desired to use same. The final product is shipped in boxes with about 25 seals per sheet. Notably, instructions 30 can be printed onto sheets 60 or strip 16 at any time.

Figure 9:
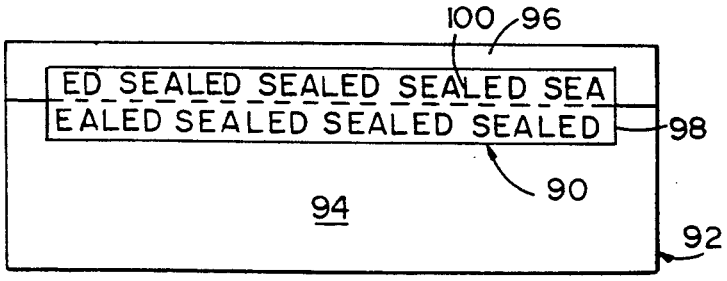
FIG. 9 is a schematic of a second security seal embodying the present invention.

A seal 90 (FIG. 9) can also be made for application onto an envelope 92 or other similar security bag with exposed flat surfaces 94 and 96. Seal 90 is substantially a tamper indicating tape 98 such as was described above for tape 18. Indicia 100 is printed directly onto the adhesive of tape 98 before application of tape 90 to flat surfaces 94 and 96. If seal 90 is removed, indications appear similar to the "VOID" indication 22 and 23 noted above. Also, the printed indicia 100 is blurred and physically separated, as also noted above. Notably, seal 90 could be pre-applied to envelope 92, or applied on-site.

Thus, a security seal is provided for detecting relative motion between two members. The seal includes an adhesive means joining the two members together at a location whereat the relative motion is to be detected, the adhesive means having printed indicia applied directly thereon in a pattern prior to joining the two members together at the location, and access means for inspecting the printed indicia as applied. The indicia pattern is disrupted upon relative motion between the members after initial joinder by the adhesive, thus reflecting that the seal has been tampered with.

Though the preferred embodiment has been described in detail herein, the invention is not intended to be limited to the preferred embodiment described, but is intended to be interpreted broadly as claimed and as interpreted under the Doctrine of Equivalents.

The embodiments of the invention in which an exclusive property or privilege is claimed are defined as follows:

1. A security seal for detecting relative motion between two members comprising:

a flexible strip including the two members;

an adhesive means joining said two members together at a location wherein said relative motion is to be detected so that said flexible strip takes on the shape of a loop, said adhesive means having printed indicia applied directly thereon in a pattern prior to joining said two members together at said location; and means for inspecting said printed indicia as applied, said indicia pattern being disrupted upon relative motion between said members after initial joinder by said adhesive reflecting that the seal has been tampered with.

2. A security seal as set forth in claim 1 wherein said two members are transparent or translucent at said location to permit visual inspection of said indicia pattern.

3. A security seal as set forth in claim 2 wherein said indicia is an ink that can be applied by a printing process directly on the adhesive means without contacting the adhesive means.

4. A security seal for detecting relative motion between two members comprising:

a flexible strip, said tow members being part of said flexible strip;

an adhesive means joining said two members together at a location wherein said relative motion is to be detected, said adhesive means having printed indicia in the form of ink applied directly on the adhesive means in a pattern prior to joining said two members together at said location, at least one of the two members being transparent or translucent at said location to permit visual inspection of said indicia pattern; and means for inspecting said printed indicia as applied, said indicia pattern being disrupted upon relative motion between said members after initially joinder by said adhesive reflecting that the seal has been tampered with.

5. A security seal as set forth in claim 4 wherein said strip includes means for temporarily holding said strip in a loop while said two members are aligned before said two members are joined.

6. A security seal as set forth in claim 5 wherein said means for temporarily holding includes an aperture intermediate the length of said strip, and said strip further includes an end that can be placed at least part way through said aperture.

7. A security seal as set forth in claim 1 wherein said indicia is an ink capable of being applied by a printing process directly on the adhesive means without contacting the adhesive means.

8. A security seal for detecting relative motion between two members comprising:

a flexible strip including the two members;

an adhesive means joining said two members together at a location wherein said relative motion is to be detected, said adhesive means having printed indicia applied directly thereon in a pattern prior to joining said two members together at said location;

means for inspecting said printed indicia as applied, said indicia pattern being disrupted upon relative motion between said members after initial joinder by said adhesive reflecting that the seal has been tampered with; and said strip including means for temporarily holding said strip in a loop while said two members are aligned before said two members are joined.

9. A security seal as set forth in claim 1 wherein said adhesive means is part of a tamper indicating tape, said tamper indicating tape including a second means for indicating relative motion between said members.

10. A security seal for detecting relative motion between two members comprising:

a flexible strip;

an adhesive means joining said two members together at a location wherein said relative motion is to be detected, said adhesive means having printed indicia applied directly thereon in a pattern prior to joining said two members together at said location, said adhesive means being part of a tamper indicating tape, said tamper indicating tape including a second means for indicating relative motion between said members;

said two members being part of said strip, and said tamper indicating tape being applied to one end of said strip on one of said two members before the joining of said two members; and means for inspecting said printed indicia as applied, said indicia pattern being disrupted upon relative motion between said members after initial joinder by said adhesive reflecting that the seal has been tampered with.

11. A security seal as set forth in claim 10 wherein said tamper indicating tape forms a legible message when said two members are separated.

12. A security seal as set forth in claim 10 including an aperture intermediate the length of said strip, and said strip further includes an end that can be placed at least part way through said aperture for temporarily holding same.

13. A security seal for detecting relative motion between two members comprising:

an adhesive means joining said two members together at a location wherein said relative motion is to be detected, said adhesive means having printed indicia applied directly on the adhesive means in a pattern prior to joining said two members together at said location, both of said two members being transparent or translucent, and the disruption of said printed indicia being visible from both sides of said two members at said location; and means for inspecting said printed indicia as applied, said indicia pattern being disrupted upon relative motion between said members after initial joinder by said adhesive reflecting that the seal has been tampered with.

14. A sheet including a plurality of said security seals as set forth in claim 1, said sheet including tab means for holding said plurality in a planar arrangement to facilitate handling, shipping and storage of said security seals, said tab means being severable to separate individual of said security seals for use.

15. A security seal for detecting relative motion between two members comprising:

an adhesive means joining said two members together at a location wherein said relative motion is to be detected, said adhesive means having printed indicia applied directly thereon in a pattern prior to joining said two members together at said location;

means for inspecting said printed indicia as applied, said indicia pattern being disrupted upon relative motion between said members after initial joinder by said adhesive reflecting that the seal has been tampered with; and a heat sensitive material that provides evidence of tampering if heated above a predetermined temperature, said heat sensitive material being applied to said adhesive means.

16. A security seal for a shipping container including an access port and a movable door for covering the access port operatively associated therewith, comprising:

a flexible strip including two portions;

adhesive means joining said two portions together so that said flexible strip forms a loop, said loop being shaped to operably connect the container and the movable door so that the access port cannot be entered without breaking said loop, said adhesive means joining said two portions at a location whereat relative motion is to be detected, said adhesive means including tamper indicating means for indicating relative motion between said two portions; and means for inspecting said tamper indicating means, said tamper indicating means being detectably disturbed upon relative motion between said two portions after initial joinder by said adhesive reflecting that said security seal has been tampered with.

17. A security seal as set forth in claim 16 wherein said tamper indicating means gives a visible indication upon experiencing said relative motion, and said flexible strip is transparent or translucent along at least a part of one of said two portions, thereby allowing visual inspection of said tamper indicating means.

18. A security seal as set forth in claim 17 wherein both of said two portions are transparent or translucent, and said visible indication can be seen through either of said two portions.

19. A security seal as set forth in claim 17 wherein said visible indication is in the form of a word.

20. A security seal as set forth in claim 16 wherein said tamper indicating means includes means for separating a first part of said adhesive means with one of said two portions, and means for separating a second part of said adhesive means with the other of said two portions.

21. A security seal as set forth in claim 16 wherein said adhesive means includes a tacky adhesive, and said tamper indicating means includes a disruptable pattern of indicia applied directly on said adhesive prior to joining said two portions together at said location.

22. A security seal as set forth in claim 21 wherein said disruptable pattern includes an ink that can be applied by a noncontact printing process.

23. A security seal as set forth in claim 16 wherein said adhesive means includes a tamper indicating tape.

24. A security seal as set forth in claim 16 including an aperture intermediate the length of said flexible strip, and said flexible strip further includes an end that can be placed at least part way through said aperture for temporarily holding same while said two portions are adhesively joined.

25. A security seal as set forth in claim 16 wherein said tamper indicating means includes at least two different modes for indicating said relative motion.

26. A security seal as set forth in claim 16 including temperature sensitive means for evidencing if said tamper indicating means has been heated above a predetermined temperature, said temperature sensitive means being located on one of said flexible strip or said adhesive means.

27. A security seal as set forth in claim 26 wherein said temperature sensitive means includes a material that changes color if heated above said predetermined temperature.

28. A security seal for detecting tampering comprising:

a flexible strip including a portion to be attached to a receiving surface;

adhesive means located on said portion of said strip including an exposed side for adheringly attaching said portion to the receiving surface;

indicia printed on said exposed surface of said adhesive in a predetermined pattern before attaching said portion to the receiving surface;

said adhesive means including disruption means for disrupting said predetermined pattern if said portion of said strip is moved relative to the receiving surface after attachment; and inspection means for sensing if said pattern has been disrupted.

29. A security seal as set forth in claim 28 wherein said disruption means blurs said predetermined pattern upon experiencing the relative movement so that said portion cannot be reattached to the receiving surface without detection.

30. A security seal as set forth in claim 28 wherein said adhesive means includes a tacky adhesive.

31. A security seal as set forth in claim 28 wherein said disruption means separates said predetermined pattern upon experiencing the relative movement, a first part of said predetermined pattern remaining with said portion of said strip, and a second part of said predetermined pattern remaining on the receiving surface.

32. A security seal as set forth in claim 31 wherein at least one of said first and second part form a visible message in the form of a word.

33. A security seal as set forth in claim 28 including heat sensitive material that provides evidence of tampering if heated above a predetermined temperature, said heat sensitive material being applied to one of said flexible strip or said adhesive means.

34. A method for detecting tampering comprising:
providing a flexible strip with adhesive thereon, said adhesive having an exposed surface;
printing a disruptable pattern on said exposed surface;
adhering said strip to a receiving surface by use of said adhesive, said receiving surface being located on said strip, said pattern being intact as applied but disruptable if said strip is moved relative to said receiving surface thereafter;
inspecting said pattern to determine if said pattern has been disrupted;
threading said flexible strip around two shipping container members to be held together; and
adhering said strip to itself to form a loop which must be broken if said shipping container members are to be separated.

35. A method for detecting tampering comprising:
providing a flexible strip with adhesive thereon, the said adhesive having an exposed surface;
printing a disruptable pattern on said exposed surface;
adhering said strip to a receiving surface by use of said adhesive, said pattern being intact as applied but disruptable if said strip is moved relative to receiving surface thereafter;
inspecting said pattern to determine if said pattern has been disrupted; and
providing a heat sensitive material located on one of said flexible strip or said adhesive, and inspecting said heat sensitive material to determine if said heat sensitive material has been heated above a predetermined temperature.

36. A method for detecting tampering with a shipping container which is provided with an access port, a moveable door operatively associated with the access port, and a lockable mechanism associated with the door, comprising:
providing a security seal having a first portion with adhesive thereon with a disruptable pattern printed on said adhesive, and a second portion;
extending said security seal through or around said lockable mechanism to prevent access to the shipping container;
adheringly joining said portions of said security seal together to form a loop by use of said adhesive, said adhesive having an adhesive strength chosen so as to disrupt said disruptable pattern upon relative movement of said portions after adheringly joining same; and
inspecting said disruptable pattern to determine if said relative movement has occurred and hence if said lockable mechanism has been tampered with.

37. A process for making security seals comprising:
providing a flexible strip with adhesive located therein, said adhesive having an exposed surface;
printing a disruptable pattern on said exposed surface; and
providing a releasable protective cover over said adhesive, removing said protective cover to expose said exposed surface to allow said step of printing, and reattaching said protective cover at least partially to said exposed surface to prevent accidental adhering of said exposed surface to an undesired surface.

38. A process for making security seals comprising:
providing a flexible strip with adhesive located therein, said adhesive having an exposed surface;
printing a disruptable pattern on said exposed surface;
providing a flexible sheet having an edge; and
attaching said flexible strip to said flexible sheet by use of said adhesive with part of said flexible strip and said adhesive overhanging from said edge of said flexible sheet.

39. A process as set forth in claim 38 including cutting said flexible sheet and said flexible strip into a plurality of elongated security seals.

40. A process as set forth in claim 39 wherein said step of cutting includes leaving one or more tabs to hold adjacent of said security seals together so that said seals can be held in the arrangement of a flat sheet to facilitate shipping, storing, and handling of said seals, said tab means being severable so that said security seals can be readily removed from each other for use, and removing said seals from said sheet for use.

41. A process for making security seals comprising:
providing a flexible strip with adhesive located therein, said adhesive having an exposed surface;
printing a disruptable pattern on said exposed surface; and
printing a pattern of heat sensitive material on one of said flexible strip or said exposed surface.

42. A security seal for a shipping container, the shipping container including an access port and a movable door for covering the access port operably associated therewith and further including a clasp for holding same closed, comprising:
a narrow clear plastic strip including a first and second end, said first end being tapered to form a tongue portion, said plastic strip further including means defining an opening spaced from said second end to permit said tongue portion to be frictionally inserted in said opening to form an initial closed loop after said plastic strip is inserted through the clasp of the container to be sealed;
adhesive means applied to said second end outwardly of said opening for adhering said plastic strip in a permanent loop, said adhesive means including a void indicating tape with void indicating means therein for displaying a void pattern upon tampering;
a releasable covering for covering said adhesive means which, when removed, permits said second end to be adhered to said first end of said strip inwardly of said tongue portion permanently securing said plastic strip in a closed loop such that if said adhesive means is tampered with by relative movement of said adhered ends, said void pattern will reflect the evidence of tampering; and
additional indicia applied by noncontact printing to said adhesive means prior to joinder of said ends, said additional indicia being disrupted by any relevant movement between said adhered portions thereby also indicating the presence of tampering; whereby relative movement of said two adhered members whether disrupting said adhesive or not, will interrupt at least one of said void indicating means and said additional indicia regardless of the application of excessive or reduced temperature gradients to said permanent closed loop and regardless of the amount of care taken in separating and reapplying same after the separation of said two ends.

43. A security seal for detecting relative motion between first and second surfaces having adjacent edges comprising:

a flexible strip including first and second portions;

a layer of adhesive for joining said first and second portions to said first and second surfaces, respectively;

tamper indicating means for indicating forced separation of at least one of said portions from the respective surface after attaching the one portion to the respective surface, said tamper indicating means including a first pattern of printed indicia in contact with said layer of adhesive, and further including a layer of material located between said layer of adhesive and said flexible strip portions and bonded to the flexible strip in a second pattern, said first pattern being different than said second pattern so that, when one of said first and second portions are separated from the respective of said surfaces, said layer of adhesive is disrupted in the shape of said second pattern thus also disrupting said first pattern; and means for inspecting said first and second patterns to determine if tampering activity has occurred, whereby disruption of said second pattern indicates tampering activity and disruption of said first pattern prevents reassembling the seal to the respective surface to hide the tampering activity.

44. A security seal as set forth in claim 43 wherein the second pattern forms a message, which message can be read upon inspection.

45. A security seal as set forth in claim 43 wherein said portions of said strip are translucent or transparent, and one of said layer of adhesive and said material forming said second pattern includes opaque material that is pulled away from said flexible strip upon tampering so that when one of said portions is tampered with said second pattern becomes visible, but the tampering activity cannot be easily hidden due to the existence of the first pattern which has been disrupted.

46. A security seal as set forth in claim 45 wherein said first pattern is also visible.

47. A security seal for detecting relative motion between two members comprising:

an adhesive means joining said two members together at a location wherein said relative motion is to be detected, said adhesive means having printed indicia applied directly thereon in a pattern prior to joining said two members together at said location; and means for inspecting said printed indicia as applied, said indicia pattern being disrupted upon relative motion between said members after initial joinder by said adhesive reflecting that the seal has been tampered with.

* * * * *

UNITED STATES PATENT AND TRADEMARK OFFICE

CERTIFICATE OF CORRECTION

PATENT NO. : 5,219,194

DATED : June 15, 1993

INVENTOR(S) : Steven J. Trent et al.

It is certified that error appears in the above-identified patent and that said Letters Patent is hereby corrected as shown below:

On the title page, item [57]:

In the Abstract, line 1;
After "tampering" insert --are provided--.

Column 7, line 58;
"tow" should be --two--.

Column 9, line 44, claim 16;
After "means" insert --for--.

Signed and Sealed this

Twenty-sixth Day of April, 1994

Bruce Lehman

*Attest:*

BRUCE LEHMAN

*Attesting Officer*

*Commissioner of Patents and Trademarks*